US008094520B2

(12) United States Patent
Bradley

(10) Patent No.: US 8,094,520 B2
(45) Date of Patent: Jan. 10, 2012

(54) SONAR MOUNT

(76) Inventor: Reason Bradley, Mill Valley, CA (US)

( * ) Notice: Subject to any disclaimer, the term of this patent is extended or adjusted under 35 U.S.C. 154(b) by 0 days.

(21) Appl. No.: 12/884,745

(22) Filed: Sep. 17, 2010

(65) Prior Publication Data

US 2011/0069586 A1 Mar. 24, 2011

Related U.S. Application Data

(60) Provisional application No. 61/243,750, filed on Sep. 18, 2009.

(51) Int. Cl.
*G10K 11/00* (2006.01)

(52) U.S. Cl. ..... 367/173

(58) Field of Classification Search ..... 367/165, 367/173

See application file for complete search history.

(56) References Cited

U.S. PATENT DOCUMENTS

| | | | | |
|---|---|---|---|---|
| 4,815,048 | A * | 3/1989 | Boucher et al. | 367/173 |
| 4,982,924 | A * | 1/1991 | Havins | 367/173 |
| 5,182,732 | A * | 1/1993 | Pichowkin | 367/173 |
| 2002/0067662 | A1 * | 6/2002 | Carney | 367/173 |

* cited by examiner

*Primary Examiner* — Ian Lobo
(74) *Attorney, Agent, or Firm* — Michael A. Glenn; Glenn Patent Group

(57) ABSTRACT

A sonar mount allows accurate and precise alignment of a sonar head to a boat. A tilt mechanism allows the sonar head to be lifted to a position that is substantially parallel to the boat's deck, thus facilitating placement of the boat on a trailer without the need to remove the sonar head from the boat.

8 Claims, 8 Drawing Sheets

SONAR MOUNT

CROSS REFERENCE TO RELATED APPLICATIONS

This application claims benefit of U.S. Provisional Application Ser. No. 61/243,750, filed Sep. 18, 2009, which is incorporated herein in its entirety by this reference thereto.

BACKGROUND OF THE INVENTION

1. Technical Field

The invention relates to electronic equipment that is used in connection with boats and ships. More particularly, the invention relates to a sonar mount for use with a boat or ship.

2. Description of the Background Art

Sonar surveys are an important part of ship navigation, dredging compliance, finding underwater objects, maintaining safe waterways and mapping. The usefulness of sonar is directly affected by the accuracy and precision with which the sonar head is mounted to the boat or ship. Sonar equipment typically consists of an electronics unit, which is placed over the side of the boat for the operator to use, and a sonar head unit, which is placed below the waterline. Accurate and precise repeatable placement of the sonar head is critical to correct operation of the sonar equipment. Most sonar surveys are done by boats where the sonar mount is added to the boat rather than at the time of vessel manufacture. Often when a survey vessel has been outfitted for sonar surveys, then a provision must also be made for removing or otherwise relocating the sonar head from the boat when the boat is placed on a trailer or when rafted or docked. This is because of road width restrictions and because the sonar head typically projects well below the bottom of the boat's hull and, as such, would prevent the boat from being trailered without first removing or relocating the sonar head. This introduces many problems with regard to recalibrating the sonar head to the boat when it is replaced. Further, the sonar head is typically part of a heavy mounting assembly and, as such, positioning and replacing the sonar head is not a trivial task. This is further complicated by the fact that it is desirable to have a "break away" method of protecting the expensive sonar head that safely rotates the unit in the case it runs into an underwater or other obstruction. Otherwise, damage to the sonar head can exceed the value of the vessel.

SUMMARY OF THE INVENTION

An embodiment of the invention provides a sonar mount that allows repeatable, accurate and precise alignment of a sonar head to a boat. A tilt mechanism allows the sonar head to be lifted to a position that is substantially parallel to the boat's deck, thus facilitating placement of the boat on a trailer without the need to remove the sonar head from the boat. The tilt mechanism also allows the sonar pole to lock in the fore or aft position on the vessel when transiting in the water. This tilt mechanism also doubles as a breakaway safety mechanism.

DETAILED DESCRIPTION OF THE INVENTION

Figure 1:
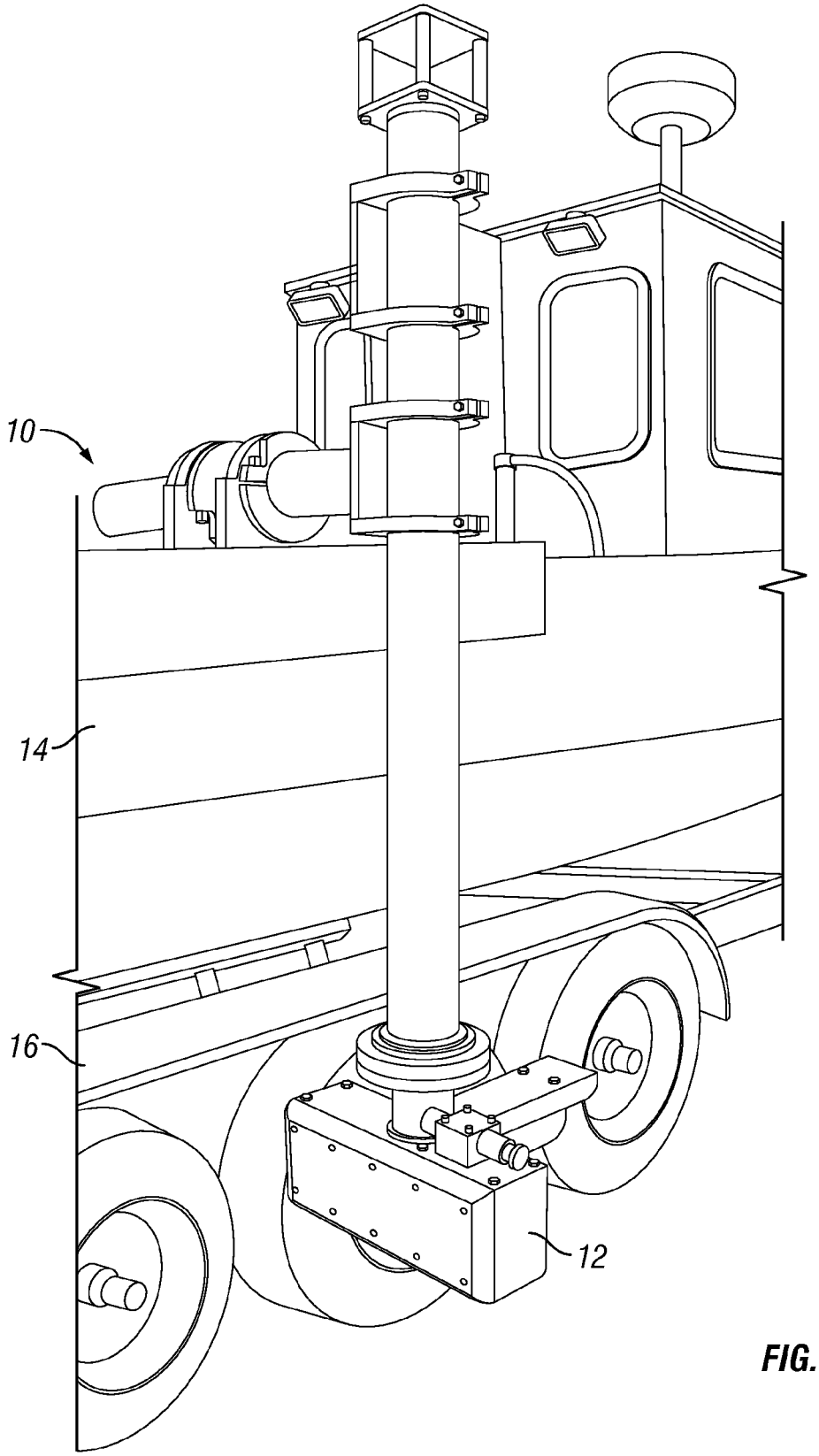
FIG. 1 is a perspective view of a sonar mount affixed to a boat according to the invention.

FIG. 1 is a perspective view of a sonar mount affixed to a boat according to the invention. In FIG. 1, a boat 14 rests upon a trailer 16. A sonar head unit 12 is attached to an end of a sonar mount 10, the sonar mount attached to the deck of the boat. An embodiment of the invention provides a sonar mount, as shown in FIG. 1, that is readily adjusted for a precise and accurate alignment relative to the boat; and that is tiltable about an axis of rotation to allow the sonar head to be elevated when the boat is on a trailer, for example, and to be readily lowered into an operable position when the boat is in the water. The sonar mount may also be tilted to a vertical position and serve as an antenna mast (discussed below).

Figure 2:
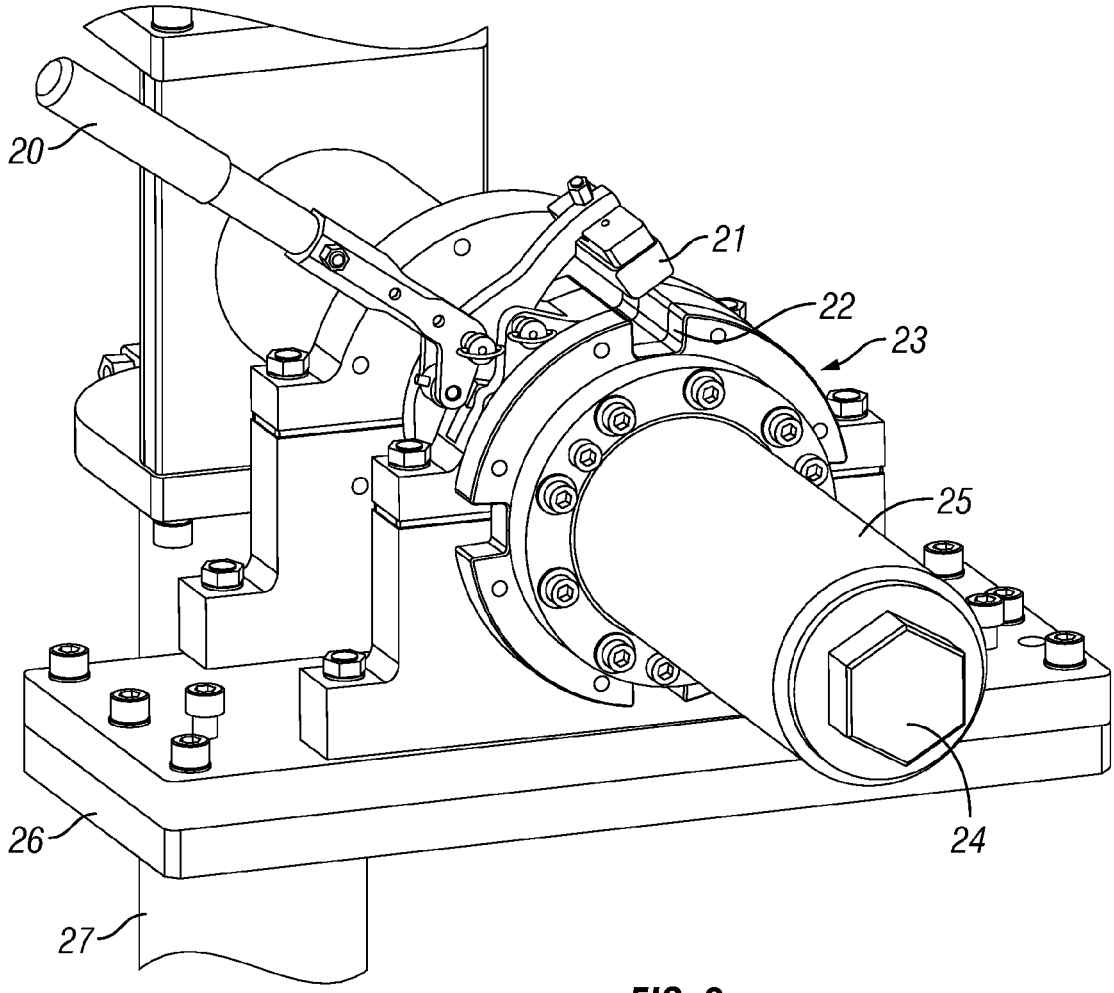
FIG. 2 is a perspective view of a sonar mount showing a clamp assembly according to the invention.

FIG. 2 is a perspective view of a sonar mount showing a clamp assembly according to the invention. In FIG. 2, the sonar mount is shown having a base plate 26 with clamp bolts. An embodiment of the invention provides a compound base plate (discussed below). The base plate is secured to the deck of a boat by bolts, screws, or other such fastening and/or securing mechanisms.

The sonar mount includes a clamping assembly that comprises a tube collar assembly 23 which is clamped is a cross tube 25 (the cross tube clamp is discussed in greater detail below). The cross tube rotates about an axis to effect tilting of the sonar head. The cross tube is locked into a desired orientation by operation of a clamp lever 20 which, in turn, selectively engages and disengages a pawl 2 with one of two or more notches 22 formed in a periphery of the tube collar assembly. The cross tube is coupled to a Z tube 27. The Z tube is arranged perpendicular to the cross tube in this embodiment and supports the sonar head, as discussed in greater detail below.

The sonar mount may be operated to raise and lower the sonar head with a wrench (not shown). A lift head 24 is provided to receive a wrench or other tool, which wrench or tool is then used to rotate that cross tube which, in turn, raises or lowers the Z tube, and thus raises or lowers the sonar head.

Figure 3:
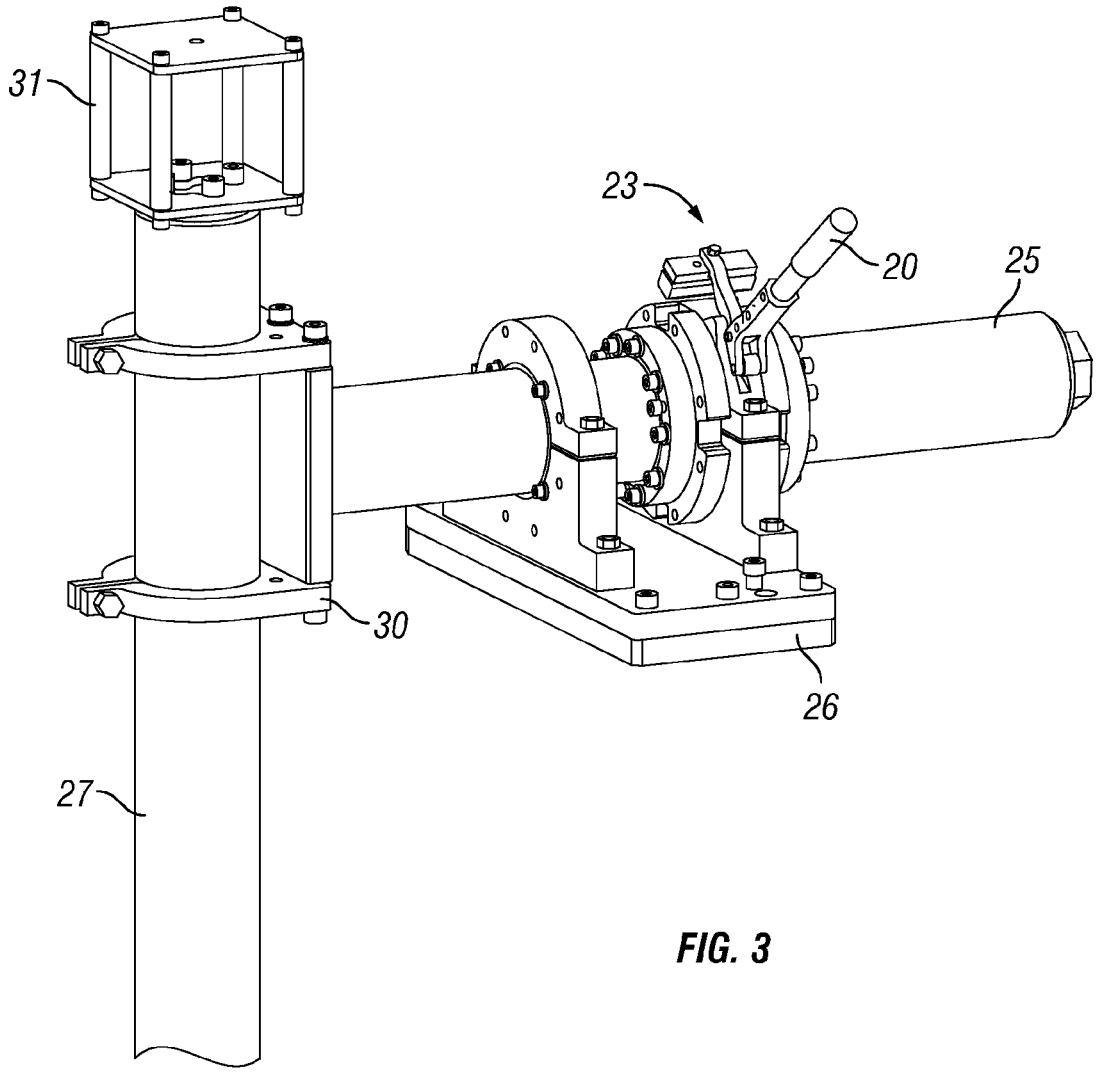
FIG. 3 is a perspective view of a sonar mount showing a cross tube and a Z tube, in which the Z tube is in a vertical orientation, according to the invention.

FIG. 3 is a perspective view of a sonar mount showing a cross tube and a Z tube, in which the Z tube is in a vertical orientation, according to the invention. In FIG. 3, the cross tube is shown coupled to the Z tube by a Z clamp assembly 30. An antenna head 31 is also provided. Thus, the sonar mount may serve a dual function of supporting a sonar head when the Z tube is oriented vertically downward and an antenna when the Z tube is oriented vertically upward.

Figure 4:
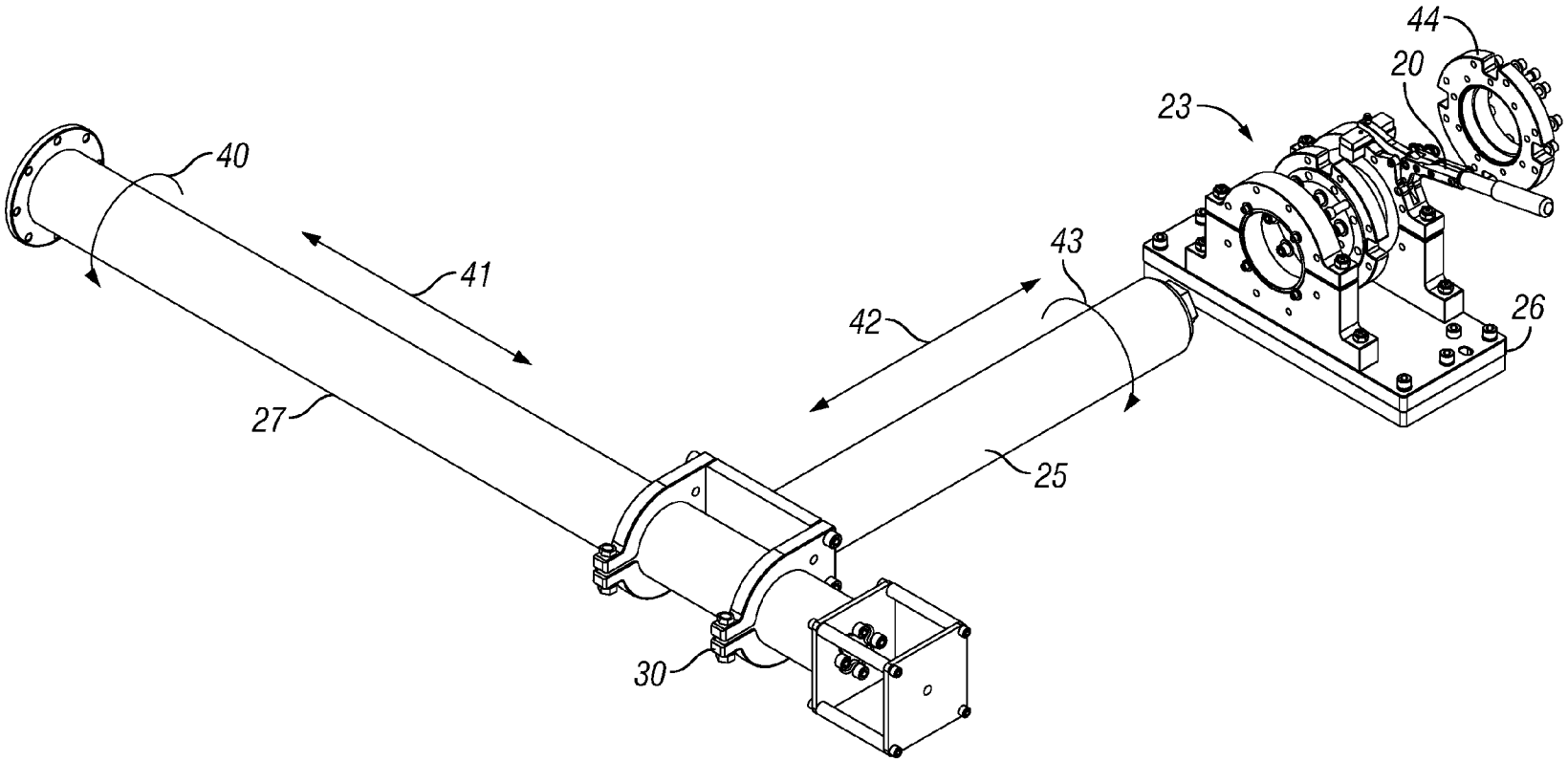
FIG. 4 is an exploded perspective view of a sonar mount showing a clamp assembly, a cross tube, and a Z tube, in which the Z tube is in a horizontal orientation, according to the invention.

FIG. 4 is an exploded perspective view of a sonar mount showing a clamp assembly, an X tube, and a Z tube, in which the Z tube is in a horizontal orientation, according to the invention. In FIG. 4, it can be seen that the X tube is adjustable in an (in/out) direction 42 and the pitch of the cross tube is adjustable 43. These adjustments are made possible by a clamping mechanism comprising a tube collar assembly 44 (discussed below). When the clamping mechanism is released, the cross tube is movable to adjust the cross tube's pitch and Z position. The Z position adjustment allows the Z tube (and the sonar head) to be positioned relative to the side of the boat when the sonar head is lowered into the water. Thus, this adjustment allows precise setting of the spacing of the sonar head from the side of the boat. The pitch adjustment allows the cross pole to be positioned perpendicular to the surface of the water with a notch in the tube collar positioned at tube dead center. It is typical for a boat to have a sloping deck. If this adjustment where not provided, then the base plate would establish the pitch of the cross tube. If this pitch were not parallel to the surface of the water, then the Z tube would not be perpendicular to the surface of the water when the sonar head is lowered into its operating position. The pitch adjustment allows the sonar mount to compensate for the slope of the deck. In this way, the sonar mount can lock the cross tube into position by engaging the pawl associated with the clamp lever into the notch, and assure that the Z member is perpendicular to the surface of the water. This presents a proper orientation of the sonar head.

The Z tube is secured to the cross tube by the Z clamp assembly 30. The Z clamp assembly allows adjustment of the Z tube in the Z (in/out) direction 41 to effect a proper height or depth for the sonar head, and it also allows a yaw adjustment 40 to position the sonar head parallel to the boat.

Figure 5:
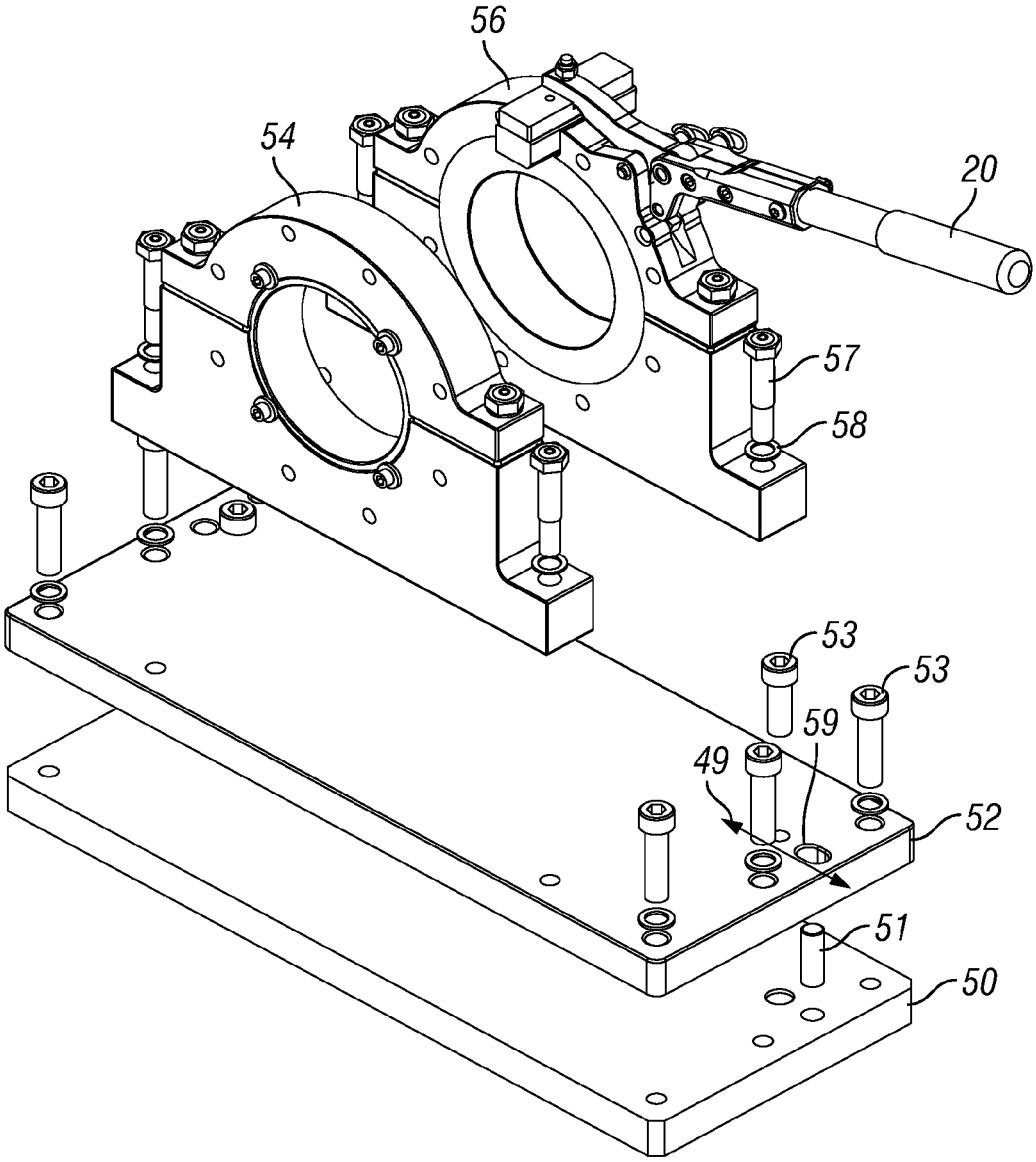
FIG. 5 is an exploded perspective view of a sonar mount showing a clamp assembly according to the invention.

FIG. 5 is an exploded perspective view of a sonar mount showing a clamp assembly according to the invention. In FIG. 5, a basic clamp block 54 serves to support and guide the cross tube and thus provides both rigidity to the sonar mount and a bearing surface to allow smooth rotation of the cross tube while raising and lowering the sonar head. The clamp lever is shown with a locking clamp block 56, described above in connection with the notch and pawl mechanism. The basis clamp block and Locking clamp block are each secured to a base plate 52 by a plurality of bolts 57 and washers 58. Those skilled in the art will appreciate that other mechanisms can be used to secure the basic clamp block and locking clamp block to the base plate, or they may even be welded thereto. The ability to repeatably locate the Base Plate 52 to the vessel means that the whole system may be removed or hinged out of the way and back again without having to recalibrate the sonar head.

The base plate mates with a fixed plate 50. The fixed plate is attached to the deck or rail of the boat, for example with screws or bolts and the based plate is attached thereto with bolts or screws 53. This two-part arrangement is advantageous in that it allows the sonar mount to be removed from the boat by separating the base plate from the fixed plate. Because the fixed plate remains attached to the boat, the alignment of the sonar head that was achieved is maintained. That is, when the base plate is recoupled to the fixed plate, the sonar mount is positioned on the boat in the exact same orientation it had before it was removed from the boat. Because the base plate and fixed plate may be subject to thermal expansion, a key pin 51 is provided with the fixed plate that engages with a linear slot 59 formed in the base plate. In this way, some linear motion is permitted along an axis 49 parallel to the boat. This allows ready engagement of the based plate and fixed plate while maintaining alignment. There is also a hinge option that allows the plate 52 to hinge 90 degrees from plate 50 thus tilting the entire sonar head and mount into the boat.

Figure 6:
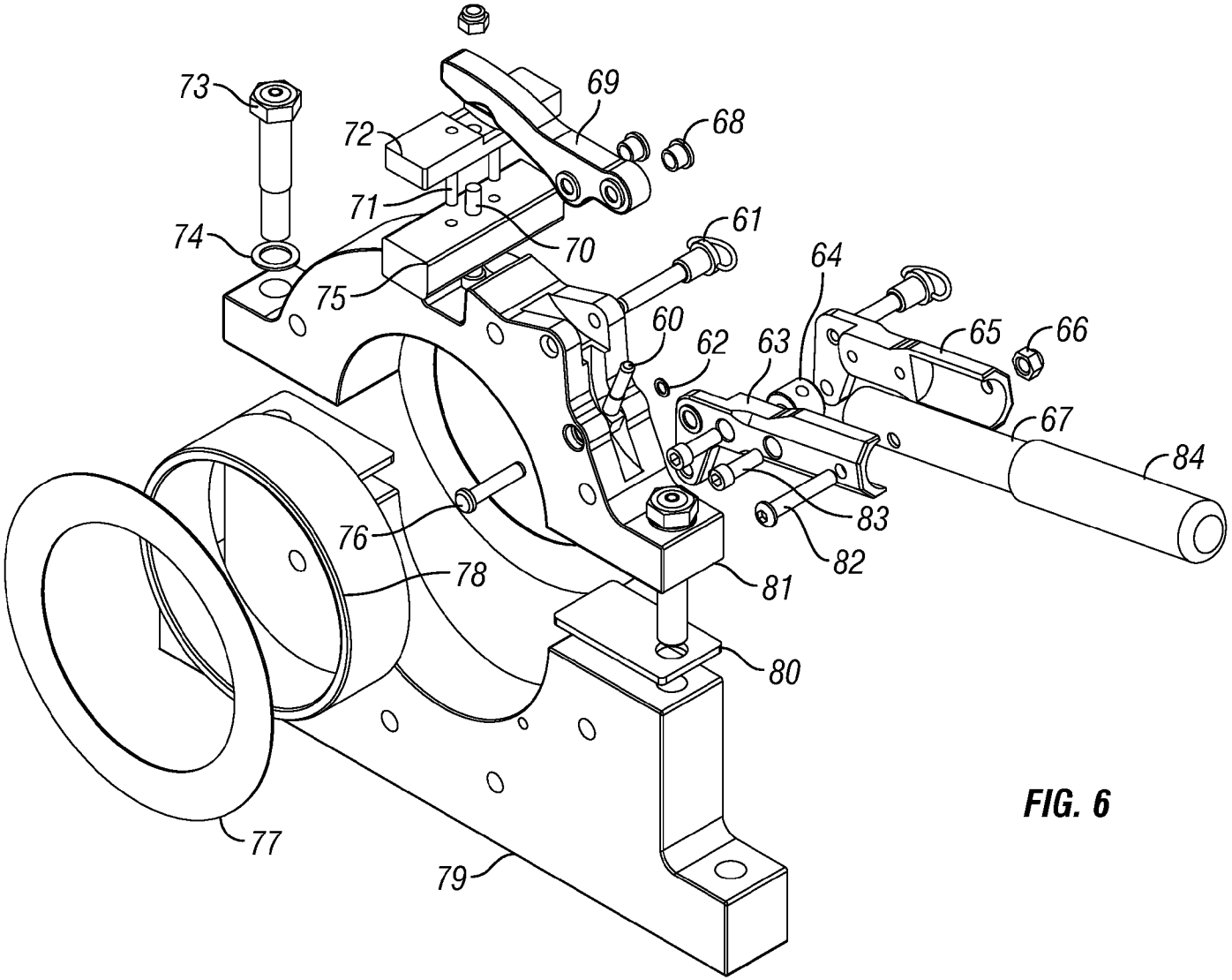
FIG. 6 is an exploded perspective view of a sonar mount showing a detail of a clamp assembly according to the invention.

FIG. 6 is an exploded perspective view of a sonar mount showing a detail of a clamp assembly according to the invention. In FIG. 6, the base clamp 79 and top clamp 81 are joined by bolts 73 and washers 74 and comprise two halves of the locking clamp block that supports a clamping mechanism that, in this embodiment, includes a thrust washer 77 for the main clamp and a bushing 78 for the cross tube. A shim 80 may be provided to assure proper spacing of the base clamp and the top clamp.

The pawl comprises a shear block 75, shear block backing plate 72, dowel pin 71 and screw 70. A clamp arm 69 couples the pawl to the clamp lever, and includes a flared bushing 68 that is secured to the top clamp by a quick pin. A second quick pin secures a clamp lever front portion 63 to the clamp arm. A clevis pin 76 and retaining ring 62 secure a shoulder rod 60 to the top clamp. The shoulder rod and clamp lever front portion engage with an end of the clamp arm and with a clamp adjuster barrel 64 to effect a detent operation that locks the mechanism during a portion of its range of motion. The clamp lever includes a clamp lever back portion 65 screw 82 and nut 66, and a further screw 83, that engage to hold the clamp lever front and back together and to clamp them to a clamp lever handle extension 67, which has a grip portion 84.

The clamp block also comprises a release mechanism comprising a breakaway actuated pawl that is selectably operable to engage the pawl with a selected one of the notches in the ring to prevent rotation of the cross tube within the bushing, and that is operable to disengage the pawl from the notches to permit free rotation of the cross tube within the bushing if sufficient force is applied to the cross tube to effect a breakaway release of said pawl. For example, if the sonar head strikes an object, then the clamp mechanism releases and the sonar head may freely rotate within the mechanism, thus mitigating damage to the sonar head.

Figure 7:
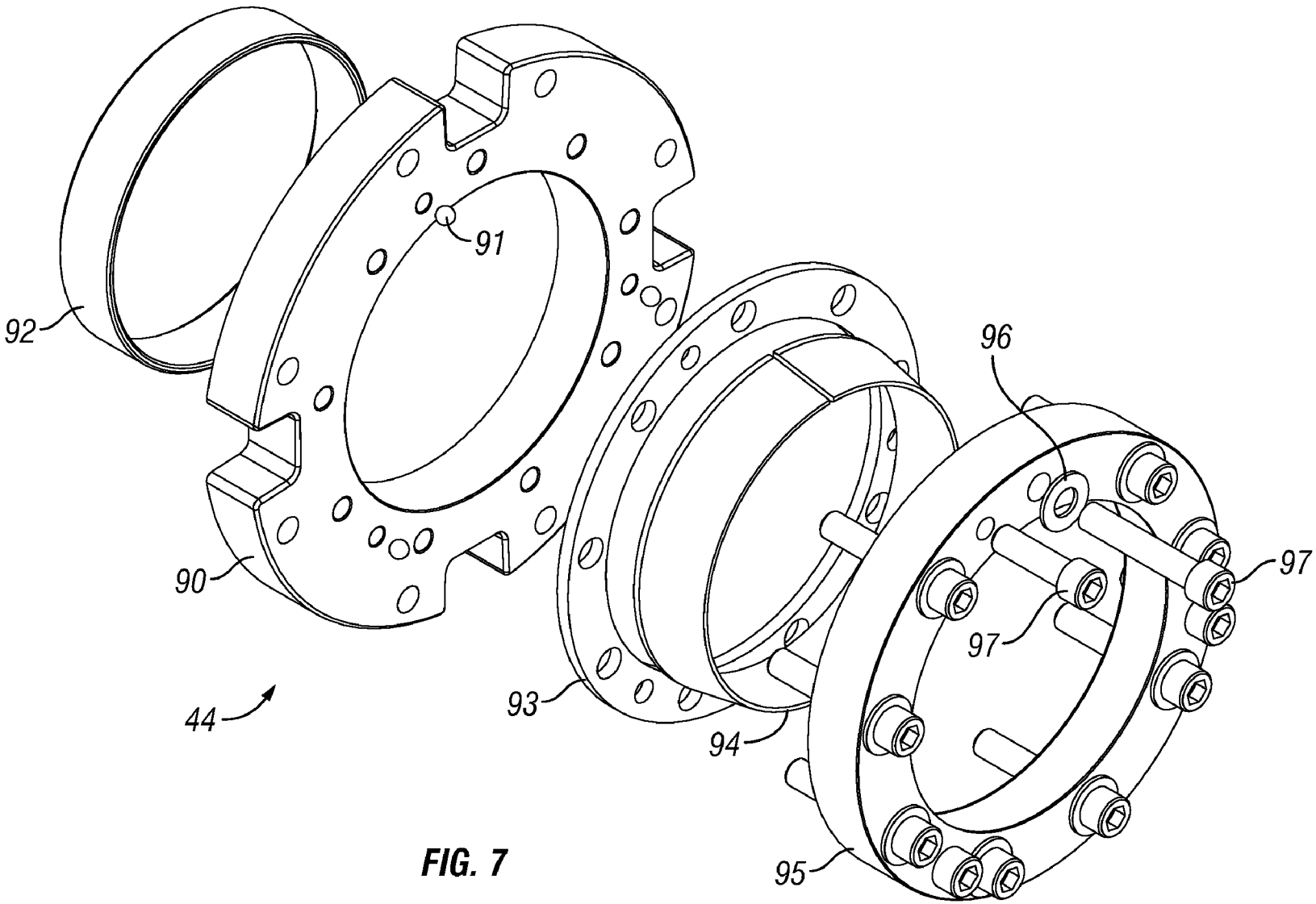
FIG. 7 is an exploded perspective view of a sonar mount showing a further detail of a clamp assembly according to the invention.

FIG. 7 is an exploded perspective view of a sonar mount showing a further detail of a clamp assembly according to the invention. This locking ring assembly is what allows the sonar head unit to have exact pitch angle adjustments to be made for a given vessel, and then repeatably rotated out of the water and back again by actuating the lever. In FIG. 7, the tube collar assembly 44 includes a bushing lock ring 92, inner clamp ring 93, and collet 94 that secure the cross tube against rotation when clamped tightly together by an outer clamp ring 95. This clamping is effected by tightening bolts 97 having corresponding washers 96. Thus, the cross tube is adjusted as preferred when the bolts are loosened and secured in a selected alignment when the bolts are tightened. A bearing mechanism is provided that consists of steel ball bearings 91 and corresponding apertures formed in the clamp bolt ring.

Figure 8:
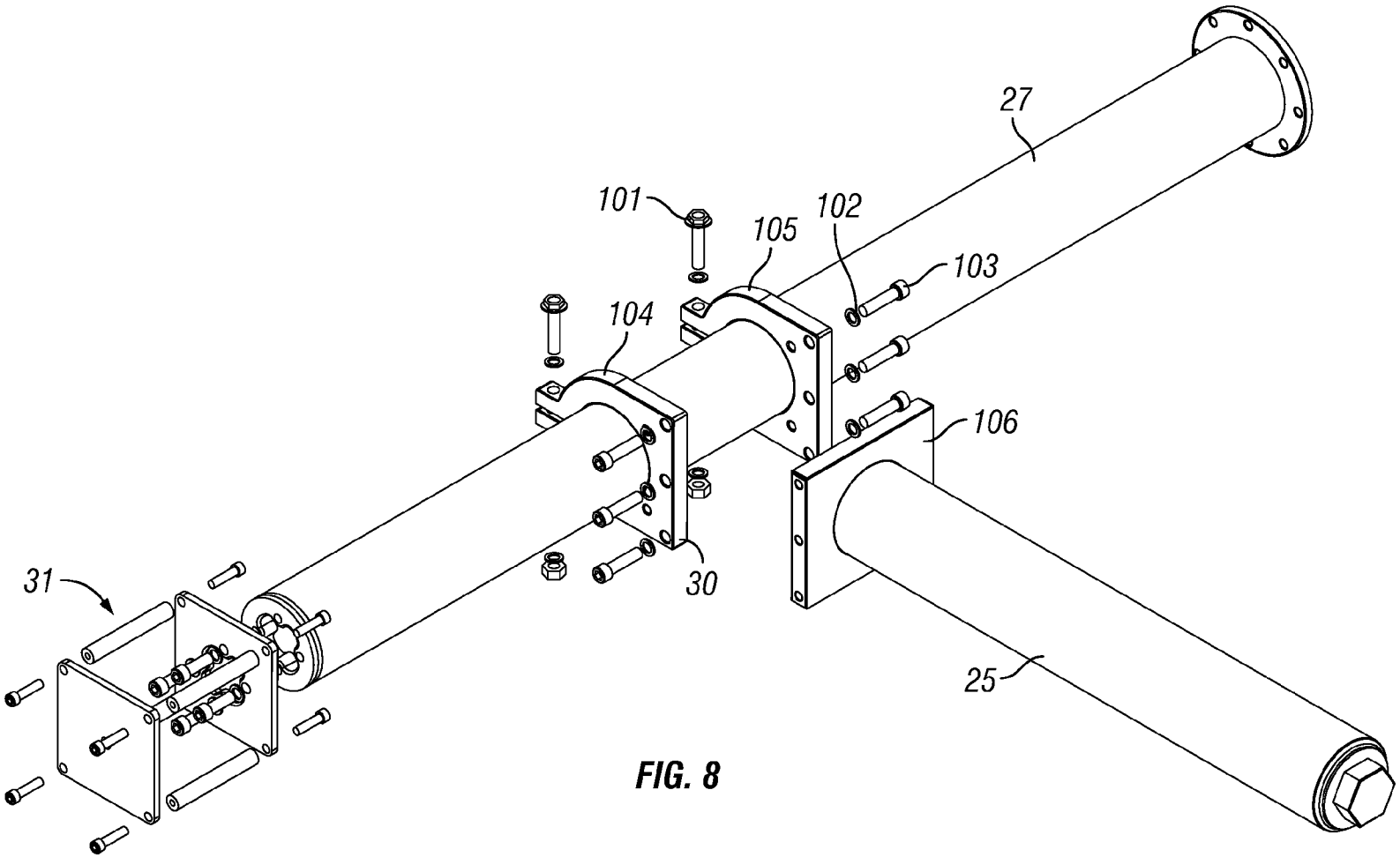
FIG. 8 is an exploded perspective view of a sonar mount showing a cross tube and a Z tube according to the invention.

FIG. 8 is an exploded perspective view of a sonar mount showing a cross tube and a Z tube according to the invention.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A tiltable mount, comprising:

a base having an attachment mechanism for securing said mount to a vehicle surface;

a clamp mechanism, secured to said base;

a cross tube, coupled to said clamp mechanism, wherein said clamp mechanism comprises a mechanism that is operable to release said cross tube to establish any of a selected Z direction and pitch adjustment, and said clamp mechanism is operable to secure said cross tube to maintain said Z direction and/or pitch established adjustment during operation of said mount;

a Z tube, coupled substantially perpendicular to an axis of said cross tube at an end of said cross tube;

an equipment mount positioned at at least one end of said Z tube;

a Z tube coupling mechanism for effecting said coupling of said Z tube to said cross tube, wherein said Z tube coupling mechanism is operable to release said Z tube to establish any of a selected Z direction and yaw adjustment, and said Z tube coupling mechanism is operable to secure said Z tube to maintain said established Z direction and/or yaw adjustment during operation of said mount; and a tilt mechanism associated with said clamp mechanism that is operable to release said cross tube for rotation about said cross tube axis to effect tilting of equipment mounted to said equipment mount, said tilt mechanism further comprising a lock mechanism that is operable to secure said cross tube at a selected position;

wherein said clamp mechanism maintains said established cross tube Z direction and/or pitch adjustment relative to said tilt mechanism during operation thereof.

2. The tiltable mount of claim 1, said clamp mechanism further comprising:

a first clamp plate having an aperture formed therethrough for receiving said cross tube;

a second clamp plate having an aperture formed therethrough for receiving said cross tube;

a collet positioned substantially between said first clamp plate and said second clamp plate and having an aperture formed therethrough for receiving said cross tube; and a fastening mechanism for selectably forcing said first clamp plate and said second clamp plate together to cause said collet to clamp said cross tube securely against movement of said cross tube relative to said clamp mechanism, and for selectably releasing said first clamp plate from said second clamp plate to cause said collet to release said cross tube and permit movement of said cross tube relative to said clamp mechanism.

3. The tiltable mount of claim 1, said tilt mechanism further comprising:

a ring associated with said clamp mechanism, said ring comprising a plurality of notches formed therein about a circumference thereof;

wherein said clamp mechanism is secured to said cross tube in an established, fixed relation thereto;

a bushing having an aperture formed therethrough for receiving said cross tube, said aperture having a sufficient diameter to permit free rotation of said cross tube therein;

a release mechanism comprising a lever actuated pawl that is selectably operable to engage said pawl with a selected one of said notches in said ring to prevent rotation of said cross tube within said bushing, and that is operable to disengage said pawl from said notches to permit free rotation of said cross tube within said bushing to effect tilting of equipment associated with said Z tube.

4. The tiltable mount of claim 1, further comprising:

an enlarged bolt head associated with an end of said cross tube opposite to an end associated with said Z tube; said bolt head having a profile that engages with a lift tool;

wherein said lift tool is operable to rotate said cross tube when said cross tube is released by said tilt mechanism.

5. The tiltable mount of claim 1, said base further comprising:

a fixed plate that is configured for attachment to said vehicle surface; and a mount plate associated with said clamp mechanism and said tilt mechanism;

a fastening mechanism that selectably secures said mount plate to said fixed plate and that allows separation of said mount plate from said fixed plate; and a key mechanism for maintaining alignment between said fixed plate and said mount plate when said mount plate is affixed to said fixed plate after removal therefrom.

6. The tiltable mount of claim 5, said base further comprising:

a hinge that allows mount plate to rotate about 90 degrees from said fixed plate;

wherein said mount is tiltable into said vehicle.

7. The tiltable mount of claim 1, wherein said vehicle is a vessel.

8. The tiltable mount of claim 1, further comprising:

a release mechanism comprising a breakaway actuated pawl that is selectably operable to engage said pawl with a selected one of said notches in said ring to prevent rotation of said cross tube within said bushing, and that is operable to disengage said pawl from said notches to permit free rotation of said cross tube within said bushing if sufficient force is applied to said cross tube to effect a breakaway release of said pawl.

* * * * *